United States Patent [19]

Naghshineh et al.

[11] Patent Number: 4,945,260

[45] Date of Patent: Jul. 31, 1990

[54] TEMPERATURE AND SUPPLY COMPENSATED ECL BANDGAP REFERENCE VOLTAGE GENERATOR

[75] Inventors: Kanoosh Naghshineh, Menlo Park; David L. Campbell, Sunnyvale, both of Calif.

[73] Assignee: Advanced Micro Devices, Inc., Sunnyvale, Calif.

[21] Appl. No.: 338,583

[22] Filed: Apr. 17, 1989

[51] Int. Cl.[5] ..... G05F 3/20

[52] U.S. Cl. ..... 307/296.6; 307/455; 323/314

[58] Field of Search ..... 307/296.6, 455; 323/314, 315

[56] References Cited

U.S. PATENT DOCUMENTS

| | | | |
|---|---|---|---|
| 3,573,504 | 4/1971 | Breuer | 307/296.6 |
| 3,794,861 | 2/1974 | Bernacchi | 307/296.6 |
| 4,352,056 | 9/1982 | Cave et al. | 323/314 |
| 4,396,883 | 8/1983 | Holloway et al. | 307/296.6 |
| 4,498,041 | 2/1985 | Kuwahara | 307/296.6 |
| 4,628,247 | 12/1986 | Rossetti | 323/314 |
| 4,631,427 | 12/1986 | Mazumder et al. | 307/296.6 |
| 4,733,160 | 3/1988 | Draxelmayr | 323/314 |
| 4,734,593 | 3/1988 | Teymouri et al. | 307/296.6 |
| 4,771,228 | 9/1988 | Hester et al. | 307/296.6 |
| 4,795,918 | 1/1989 | Menon et al. | 307/296.6 |

FOREIGN PATENT DOCUMENTS 2712531 10/1977 Fed. Rep. of Germany ..... 323/314

OTHER PUBLICATIONS

Analog Dialogue 9-1 C1975, p. 7, FIG. 3.

IEEE Journal of Solid-State Circuits, vol. SC-6, No. I, Feb. 1971, Widlar, p. 3, FIG. 2.

*Primary Examiner*—Stanley D. Miller

*Assistant Examiner*—Terry Cunningham

*Attorney, Agent, or Firm*—Davis Chin

[57] ABSTRACT

An ECL bandgap reference voltage generator includes a supply-independent current source (14) to produce an output reference voltage ($V_{BB}$) that is independent of variations of supply voltage but yet without consuming additional power dissipation. The supply-independent current source (14) is formed of a pair of transistors (Q907, Q908) and first through third resistors (R903, R904, R908).

10 Claims, 2 Drawing Sheets

TEMPERATURE AND SUPPLY COMPENSATED ECL BANDGAP REFERENCE VOLTAGE GENERATOR

BACKGROUND OF THE INVENTION

This invention relates generally to bandgap reference voltage generators and more particularly, it relates to an ECL bandgap reference voltage generator whose operation is compensated to produce an output reference voltage $V_{BB}$ that is independent of variations in supply voltage.

As is generally well-known, emitter-coupled logic (ECL) is a widely utilized logic family for high performance products due to its very short propagation delay. Therefore, in order to preserve the high performance of integrated circuits embodying ECL logic, a bandgap reference voltage $V_{CS}$ has been commonly generated heretofore on-chip and is used to control the base of the main current source transistor. This reference voltage $V_{CS}$ has the characteristic of being stable and it tracks variations in processing and changes in operating parameters such as temperature. Such a prior art bandgap reference generator 2 for producing a reference voltage $V_{CS}$ is illustrated in FIG. 1 and has been labeled "Prior Art." However, the reference voltage $V_{CS}$ suffers from the disadvantage of still varying over the supply voltage VCC.

In order to eliminate the dependence on variations in the supply voltage, a "VCC Compensation" circuit 4 was developed in the prior art and added to the bandgap reference generator 2. In operation, the transistors Q8, Q7 and Q6 in the "VCC Compensation" circuit 4 function similar to the operation of the transistors Q1, Q2 and Q3 in the bandgap reference generator 2 so that the collector current flowing through the transistor Q6 would have a specific relationship to the collector current flowing through the transistor Q3. The supply voltage VEE is generated externally and is provided to a packaged integrated circuit through a dedicated pin.

For ECL circuits, the upper supply voltage VCC is 0 volts and the lower supply voltage VEE is typically −5.0 volts, but is still considered to be acceptable if it lies within a range of ±10%. Thus, at a high lower supply voltage (VEE=−5.5 volts), the current through the current source resistor R9 is increased. In order to maintain a constant current to the collector of the transistor Q3, the current through the collector of the transistor Q6 must be increased. At a low lower supply voltage (VEE=−4.5 volts), the current through the current source resistor R9 is decreased. Therefore, in order to maintain again a constant current through the collector of the transistor Q3, the current through the collector of the transistor Q6 must be decreased. As a result, the current flowing through the collector of the transistor Q3 will be independent of variations in the supply voltage VCC.

It will be noted that the "VCC Compensation" circuit 4 is connected to the collector of the transistor Q3 and thus provides for additional circuit paths between the supply voltage VCC and the ground potential. As a consequence, the "VCC Compensation" circuit 4 has the undesirable feature of consuming additional power, which may in fact be more than the power consumption of the bandgap reference generator 2 itself.

In ECL circuits, a stable reference voltage $V_{BB}$ is also generated from a bandgap reference voltage generator and is supplied to the base of a reference transistor in order to establish the threshold level for the recognition of a high or low logic state. It would therefore be desirable to provide an improved bandgap reference generator, which includes compensation circuitry for supplying a reference voltage $V_{BB}$ that is independent of variations in supply voltage, but yet consumes no additional power. This is achieved in the present invention by the provision of compensation circuitry comprised of a supply-independent current source which supplies a constant current to the collector of a constant current source transistor in a bandgap circuit portion.

SUMMARY OF THE INVENTION

Accordingly, it is a general object of the present invention to provide an improved ECL bandgap reference voltage generator which is relatively simple and economical to manufacture and assemble, but yet overcomes the disadvantage of the prior art bandgap reference generators.

It is an object of the present invention to provide an ECL bandgap reference generator whose operation is compensated to produce an output reference voltage $V_{BB}$ that is independent of variations in supply voltage.

It is another object of the present invention to provide an ECL bandgap reference voltage generator which includes compensation circuitry comprised of a supply-independent current source for supplying a constant current to the collector of a constant current source transistor as variations in the supply voltage occur, but yet consumes no additional power.

It is still another object of the present invention to provide an ECL bandgap reference generator which includes a supply-independent current source formed of a pair of transistors and first through third resistors.

In accordance with these aims and objectives, the present invention is concerned with the provisions of an ECL bandgap reference voltage generator for producing an output reference voltage $V_{BB}$ that is compensated for variations in supply voltage which includes a bandgap circuit portion and a compensation circuit portion. The bandgap circuit portion includes parallel current branches connected between a first power supply potential and a second power supply potential, means for supplying current through the parallel branches, and a constant current source transistor to establish the output reference voltage $V_{BB}$. The constant current transistor has its base coupled to one of the parallel branches and its emitter coupled to the second power supply potential. The compensation circuit portion includes a supply-independent current source connected between the first power supply potential and the collector of the constant current source transistor to supply a constant current to the collector of the constant current source transistor as variations in the supply voltage occur.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
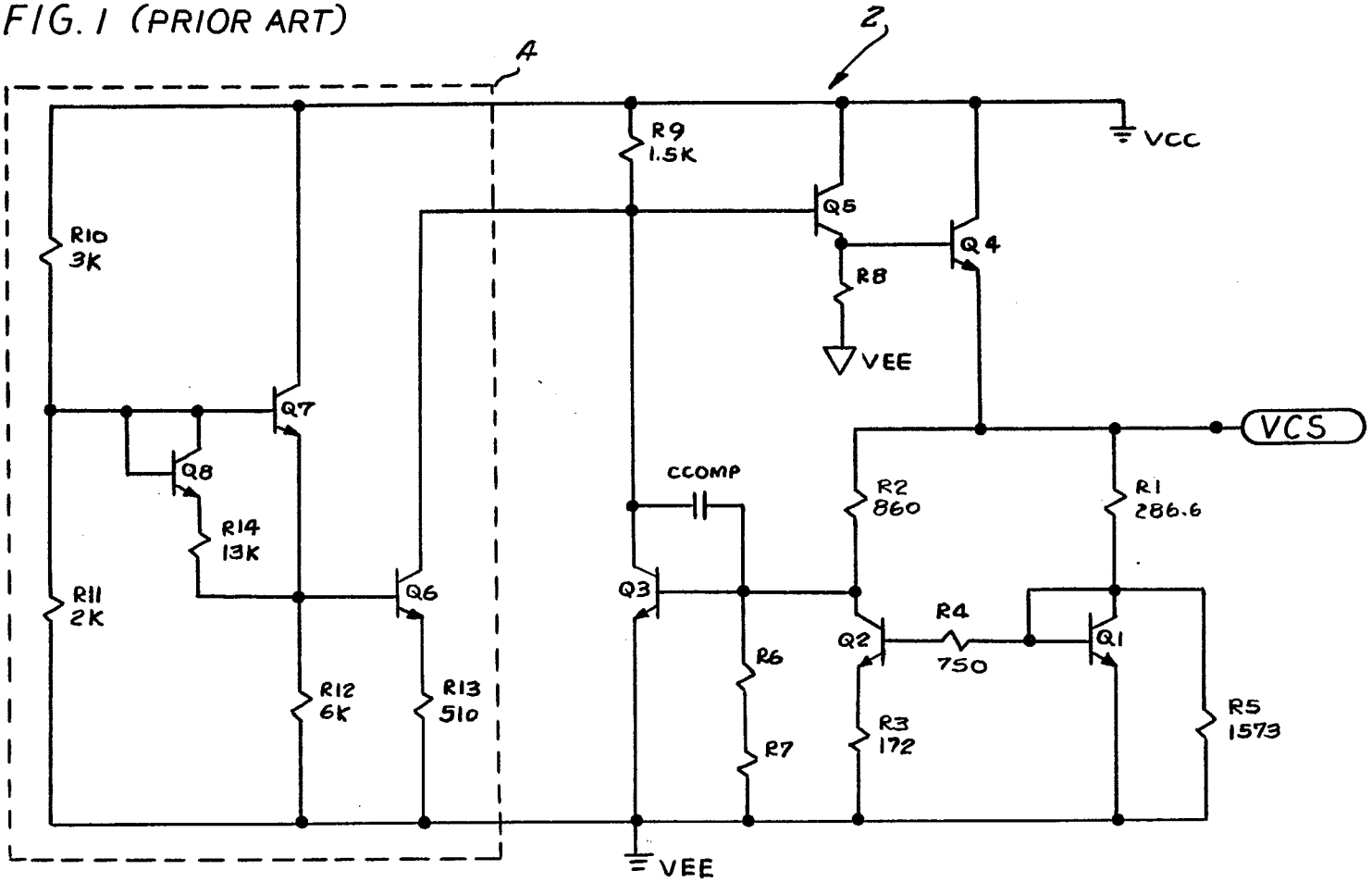
FIG. 1 (PRIOR ART)
FIG. 1 is a schematic circuit diagram of a compensated bandgap reference voltage generator of the prior art.
Figure 2:
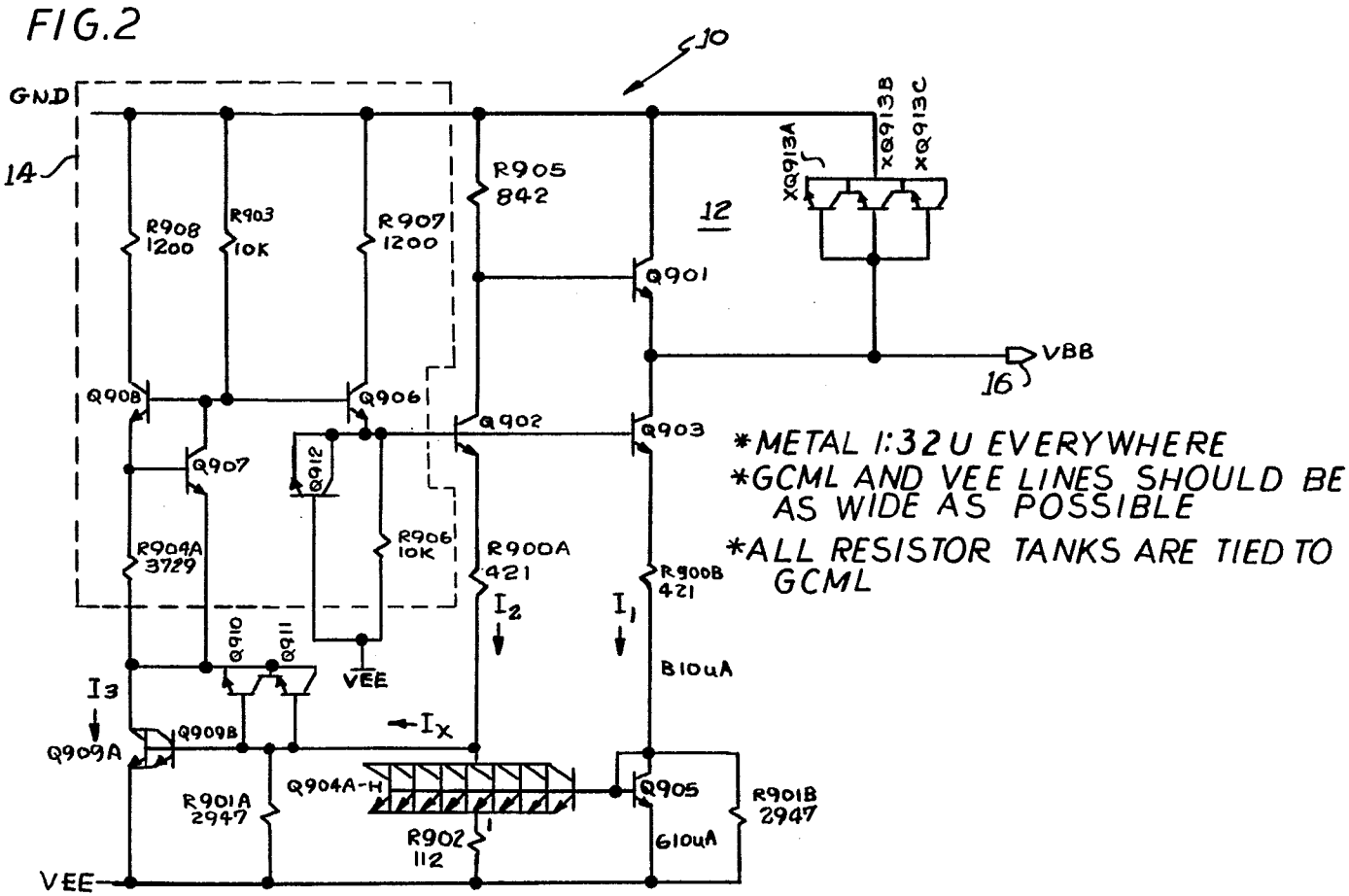
FIG. 2 is a schematic circuit diagram of a temperature and supply compensated bandgap reference voltage generator, constructed in accordance with the principles of the present invention.

In the preferred embodiment of the present invention illustrated in FIG. 2, there is provided an improved ECL bandgap reference voltage generator 10 which is formed of a bandgap circuit portion 12 and a compensation circuit portion 14. The compensation circuit portion 14 renders the performance of the bandgap circuit portion 12 to produce an output reference voltage $V_{BB}$ that is independent of variations in supply voltage.

The bandgap circuit portion 12 includes two parallel current branches which are connected between a first power supply potential GND and a second power supply potential VEE. The first power supply potential is typically at ground potential or zero volts, and the second power supply potential is typically at −5.0 volts ±10%. The first branch includes the series connection of transistor Q901, transistor Q903, resistor R900B and transistor Q905. A resistor R901B is connected in parallel across the collector of the transistor Q905 and the second power supply potential VEE. The second branch includes the series connection of resistor R905, transistor Q902, resistor R900A, transistor Q904A-H, and resistor R902. A resistor R901A is connected in parallel across the collector of the transistor Q904A-H and the second power supply potential VEE.

In order to produce a stable reference voltage $V_{BB}$ on output terminal 16, the currents through the resistor R905 and the transistor Q901 must be maintained constant over variations in supply voltage. If there is no change in the current through the resistor R905, the voltage across the resistor R905 will not change. Further, if there is no change in the collector current of the transistor Q901, the base-emitter voltage $V_{BE(901)}$ will not change. Thus, assuming that the upper supply voltage VCC is 0 volts the reference voltage $V_{BB}$ will be constant and equal to:

$$|V_{BB}| = |V_{(R905)}| + |V_{BE(Q901)}| \tag{1}$$

Initially, the current flowing through the resistor R900B is defined to be $I_1$, and the current flowing through the resistor R900A is defined to be $I_2$. Further, it is assumed that the current $I_1$ is equal to the current $I_2$. Thus, the current flowing into the collector of the transistor Q905 is equal to $I_1$-$2I_B$, where $I_B$ is the current through either the base of the transistor Q905 or transistor Q904. The ratio of the emitter areas of the transistors Q905 and Q904 is selected to be 8:1. In order to maintain the collector current of Q904 equal to the collector current of Q905, the current $I_x$ must be made equal to $2I_B$, where $I_x$ is the current flowing to the bases of a constant current source transistor Q909. The ratio of the emitter areas of the transistor Q909 and Q905 is selected to be 2:1. Consequently, the current $I_3$ at the collector of the constant current source transistor Q909 must be equal to $2I_1$ or $2I_2$ so as to render the current at its bases to be equal to $2I_B$.

Another important aspect for optimal operation of the present bandgap reference voltage generator is that operating parameters of certain of the transistors be matched. For instance, it is important that the transistors Q905, Q904 and Q909 have generally matched parameters. Similarly, the transistors Q902 and Q903 preferably have matched operating parameters.

A base-emitter voltage $V_{BE}$ of a transistor, when it is in an active state, is given by the general equation:

$$V_{BE} + \frac{kT}{q} \cdot \ln \frac{I_c}{A \cdot I_s}, \tag{2}$$

where q=electron charge
k=Boltzmann's constant
T=absolute temperature
$I_c$=collector current of transistor
A=emitter area of transistor
$I_s$=saturation current per unit area Further, it is noted that the sum of the base-emitter voltage of the transistor Q904 and the voltage drop across the resistor R902 is applied across the base-emitter path of the transistor Q905. Then, the following relationship holds:

$$V_{BE(904)} + V_{R902} = V_{BE(Q905)} \tag{3}$$

By using equation (2) in the equation (3), there is obtained:

$$\frac{kT}{q} \cdot \ln \frac{I_{904}}{A_{904} \cdot I_s} + V_{R902} = \frac{kT}{q} \cdot \ln \frac{I_{905}}{A_{905} \cdot I_s} \tag{4}$$

where $A_{904}$=emitter area of transistor Q904
$A_{905}$=emitter area of transistor Q905

Since $I_{905}=I_1-2I_B$ and $I_{904}=I_2-I_x=I_1-2I_B$ as previously discussed, these values may be substituted into equation (4) above and by solving for $V_{R902}$ there is obtained:

$$V_{R902} = V_T \cdot \ln \frac{I_1 - 2I_B}{A_{905} \cdot I_s} - V_T \cdot \ln \frac{I_1 - 2I_B}{A_{904} \cdot I_s} \tag{5}$$

where $$V_T = \frac{kT}{q},$$

a thermal voltage

By simplifying, we have:

$$V_{R902} = V_T \ln N = V_T \ln(8) \tag{6}$$

where

N is the ratio of the emitter A904 of the transistor Q904 to the emitter area $A_{905}$ of the transistor Q905.

Therefore, the voltage $V_{R902}$ is constant over the operational supply voltage range of the bandgap generator since there is no supply voltage dependent term. This voltage $V_{R902}$ is amplified through the voltage divider consisting of the resistor R905 and R902 and will apper between the first power supply potential and the base of the transistor Q901. As a result, the above equation (1) will hold true.

The present invention employs a compensation circuit portion 14 comprised of a supply-independent current source so as to make the current $I_3$ flowing at the collector of the constant current source transistor Q909 to be independent of variations in the supply voltage. This supply-independent current source includes the transistors Q907, Q908 and resistors R903, R904, and R908. As can be seen, the transistor Q907 has its collector connected to the base of the transistor Q908 and coupled to the first power supply potential GND via the resistor R903. The base of the transistor Q907 is connected to the emitter of the transistor Q908 and to one end of the resistor R904. The other end of the resistor R904 is connected to the emitter of the transistor Q907 and to the collector of the constant current source transistor Q909. The collector of the transistor Q908 is coupled also to the first power supply potential GND via the resistor R908.

The current produced by the supply-independent current source 14 is equal to $I_3$ and has two main components. The first component is the one flowing from the emitter of the transistor Q907, which changes with the supply voltage variations to the first order. The second component is the one flowing from the resistor R904, which is equal to $V_{BE(Q907)}$ divided by the resistor R904 and is independent of supply voltage variations to the first order. Therefore, in order to achieve supply voltage insensitivity, the contribution from the first component has been minimized so that most of the current supplied to the collector of the transistor Q909 is from the resistor R904. Since the transistors Q902 and Q903 are matched, their base-emitter voltage drops are also matched. By making the values of the resistors R900A and R900B to be of the same value, their voltage drops will also be equal. This results in the current $I_2$ being equal to the current $I_1$ and fulfills the initial assumption.

In order to provide base drive current to the transistors Q902 and Q903, the compensation circuit portion 14 further includes a series connection of a resistor R907, a transistor Q906, and a resistor R906. As can be seen the base of the transistor Q906 is connected to the collector of the transistor Q907, to the base of the transistor Q908, and to the first power supply potential via the resistor R903. The emitter of the transistor Q906 is connected to one end of the resistor R906 and to the bases of the transistors Q902 and Q903. The other end of the resistor R906 is connected to the second power supply potential VEE. The collector of the transistor Q906 is connected to the first power supply potential GND via the resistor R907.

The ECL bandgap reference voltage generator 10 of the present invention was built substantially as illustrated utilizing standard silicon IC processing and was found to provide a high quality supply regulation performance over the entire military temperature range. The following resistance values were used:

| RESISTOR | VALUE |
|---|---|
| R900A, R900B | 421 Ohms |
| R901A, R901B | 2.947 kOhms |
| R902 | 112 Ohms |
| R903, R906 | 10 kOhms |
| R904 | 3.729 kOhms |
| R905 | 842 Ohms |
| R907, R908 | 1.2 kOhms |

From the foregoing detailed description, it can thus be seen that the present invention provides an improved ECL bandgap reference voltage generator whose operation is compensated to produce an output reference voltage $V_{BB}$ that is independent of variations in supply voltage, but yet consumes no additional power dissipation. The bandgap of the instant invention includes compensation circuitry formed of a supply-independent current source for supplying a constant current to the collector of a constant current source transistor in a bandgap circuit portion.

While there has been illustrated and described what is at present considered to be a preferred embodiment of the present invention, it will be understood by those skilled in the art that various changes and modifications may be made, and equivalents may be substituted for elements thereof, without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An ECL bandgap reference voltage generator for producing an output reference voltage $V_{BB}$ that is compensated for variations in supply voltage, said bandgap generator comprising:

bandgap circuit portion means (12), including first and second parallel current branches connected between a first power supply potential and a second power supply potential, said first and second parallel current branches including first and second branch transistors, respectively, (Q902, Q903) for supplying current through the parallel branches, and a constant current source transistor (Q909) having its base coupled to the emitter of one of the first and second branch transistors and its emitter coupled to the second power supply potential, for establishing the output reference voltage $B_{BB}$;

compensation circuit portion means (14), including a supply-independent current source connected between the first power supply potential and the collector of the constant current source transistor (Q909), for supplying constant current to the collector of the constant current source transistor (Q909) as variations in the supply voltage occur; and said supply-independent current source being formed of a first transistor (Q907), a second transistor (Q908), a first resistor (R903), a second resistor (R904), and a third resistor (R908), said first transistor (Q907) having its collector connected to the base of said second transistor (Q908) and coupled to the first power supply potential via the first resistor (R903), said first transistor (Q907) having its base connected to the emitter of said second transistor (Q908) and coupled to the collector of said constant current source transistor (Q909) via the first resistor (R904), said second transistor (Q907) having its emitter connected to the collector of said constant current source transistor (Q909), said second transistor (Q908) having its collector coupled to the first power supply potential via the third resistor (R908).

2. A bandgap generator as claimed in claim 1, wherein the current from the emitter of said second transistor (Q907) is minimized with respect to the current flowing through the second resistor (R904) as variations in the supply voltage occur so that the current supplied to the collector of said constant current source transistor (Q909) remains constant.

3. A bandgap generator as claimed in claim 2, wherein the current flowing through the second resistor (R904) is equal to $V_{BE(Q907)}/R904$, where $V_{BE(Q907)}$ is the base-emitter voltage drop across the second transistor (Q907).

4. A bandgap generator as claimed in claim 3, wherein said second and third transistors are of the NPN-type conductivity.

5. A bandgap generator as claimed in claim 1, wherein said compensation circuit portion (14) further includes base drive means formed of a series connection of a third transistor (Q906), a fourth resistor (R907), and a fifth resistor (R906), for supplying base current to bases of said first and second branch transistors (Q902, Q903) for supplying current through the parallel branches.

6. In a bandgap reference voltage generator for producing an output reference voltage $V_{BB}$ that is compensated for variations in supply voltage, including first and second parallel current branches connected between a first power supply potential and a second power supply potential, said first and second parallel current branches including first and second branch transistors, respectively, (Q902, Q903) for supplying current through the parallel branches, and a constant current source transistor (Q909) for establishing the output reference voltage $V_{BB}$, the improvement comprising:

compensation circuit portion means (14) including a supply-independent current source connected between the first power supply potential and the collector of the constant current source transistor, for supplying a constant current to the collector of the constant current source transistor as variations in the supply voltage occur, said constant current source transistor (Q909) having its base coupled to the emitter of one of the first and second branch transistors and its emitter coupled to the second power supply potential; and said supply-independent current source being formed of a first transistor (Q907), a second transistor (Q908), a first resistor (R903), a second resistor (R904), and a third resistor (R908), said first transistor (Q907) having its collector connected to the base of said second transistor (Q908) and coupled to the first power supply potential via the first resistor (R903), said first transistor (Q907) having its base connected to the emitter of said second transistor (Q908) and coupled to the collector of said constant current source transistor (Q909) via the second resistor (R904), said first transistor (Q907) having its emitter connected to the collector of said constant current source transistor (Q909), said second transistor (Q908) having its collector coupled to the first power supply potential via the third resistor (R908).

7. In a bandgap generator as claimed in claim 6, wherein the current from the emitter of said second transistor (Q907) is minimized with respect to the current flowing through the second resistor (R904) as variations in the supply voltage occur so that the current supplied to the collector of said constant current source transistor (Q909) remains constant.

8. In a bandgap generator as claimed in claim 7, wherein the current flowing through the second resistor (R904) is equal to $V_{BE(Q907)}/R904$, where $V_{BE(Q907)}$ is the base-emitter voltage drop across the second transistor (Q907).

9. In a bandgap generator as claimed in claim 8, wherein said second and third transistors are of the NPN-type conductivity.

10. In a bandgap generator as claimed in claim 6, wherein said compensation circuit portion (14) further includes base drive means formed of a series connection of a third transistor (Q906), a fourth resistor (R907), and a fifth resistor (R906), for supplying base current to bases of said first and second branch transistors (Q902, Q903) for supplying current through the parallel branches.

* * * * *